United States Patent [19]

Suzuki et al.

[11] Patent Number: 4,930,995

[45] Date of Patent: Jun. 5, 1990

[54] DEVICE FOR REDUCING REFRIGERANT GAS PULSATIONS IN A COMPRESSOR

[75] Inventors: Shinichi Suzuki; Hiroyuki Deguchi; Takahiro Hamaoka; Sokichi Hibino, all of Kariya, Japan

[73] Assignee: Kabushiki Kaisha Toyoda Jidoshokki Seisakusho, Kariya, Japan

[21] Appl. No.: 301,248

[22] Filed: Jan. 24, 1989

[30] Foreign Application Priority Data

Jan. 25, 1988 [JP] Japan ..... 63-8473[U]

[51] Int. Cl.[5] ..... F04B 39/12; F04B 1/18

[52] U.S. Cl. ..... 417/312; 417/269

[58] Field of Search ..... 417/269, 312, 313, 540, 417/541, 542, 543; 181/403, 240, 230

[56] References Cited

U.S. PATENT DOCUMENTS 4,109,749 8/1978 Sweet ..... 181/230

4,583,922 4/1986 Iijima et al. ..... 417/312

*Primary Examiner*—Leonard E. Smith

*Assistant Examiner*—John A. Savio, III

*Attorney, Agent, or Firm*—Brooks Haidt Haffner & Delahunty

[57] ABSTRACT

In a refrigerant gas compressor wherein a refrigerant gas compressed in a cylinder bore is discharged out therefrom into a discharge chamber through a discharge port, there is provided a plurality of attenuating cavities in the discharge chamber each located in such facing relation to the discharge port that the refrigerant gas discharged through said discharge port is introduced into said cavity.

3 Claims, 5 Drawing Sheets

DEVICE FOR REDUCING REFRIGERANT GAS PULSATIONS IN A COMPRESSOR

FIELD OF THE INVENTION

The present invention relates generally to a refrigerant gas compressor adapted for use in an automotive air conditioning system and more specifically to a device in the above compressor for reducing or attenuating pulsations of refrigerant gas in a discharge chamber.

BACKGROUND OF THE INVENTION

It is generally known that a compressed refrigerant gas is caused to vibrate or pulsate when it is being discharged into a discharge chamber from a cylinder bore in a refrigerant gas compressor connected in an air conditioning system. The pulsations of the refrigerant gas in the discharge chamber are often transmitted to a pipe and condenser connected to the discharge side of the compressor and forming part of a refrigerant circuit of the air conditioning system, thereby causing development of vibrations and noise from such pipe and the condenser.

Devices have been proposed heretofore which arc designed to reduce the pulsations which cause the development of harmful and unpleasant vibrations and noise in the system, e.g. by Publications of Unexamined Japanese Patent Applications No. 56-44481 (1981) and No. 56-69476 (1981). According to these prior arts, the compressor is provided with a single attenuating chamber communicating with the discharge chamber and adapted to receive refrigerant gases discharged from the respective cylinder bores through the discharge chamber so as to attenuate the pulsations of the discharged gases which would otherwise be transmitted to the downstream external refrigerant circuit.

In the compressors of these prior arts, the discharge chamber and the attenuating chamber are provided in communication with each other through small holes formed at the bottom of the discharge chamber. With such an arrangement, however, flows of the discharged refrigerant gases from the respective cylinder bores of the compressor interfere with each other in the attenuating chamber, which in turn causes the refrigerant gases to pulsate due to such interference. Thus, these conventional compressors could not attenuate the pulsations satisfactorily. In addition, it is found extremely difficult to theoretically design the shape or configuration of the attenuating chamber in such compressors with an attempt for providing an effective reduction of the harmful pulsations.

SUMMARY OF THE INVENTION

It is an object of the present invention, therefore, to provide a refrigerant gas compressor which is capable of effectively attenuating the pulsations of the discharged refrigerant gases before the flows of such gases interfere with each other in the discharge chamber of the compressor.

In order to achieve the above object, in a refrigerant gas compressor having formed therein a plurality of cylinder bores and a discharge chamber communicable with each of said cylinder bores through a discharge port for receiving a refrigerant gas compressed in said each cylinder bore and then discharged out therefrom through said discharge port, there is provided a plurality of attenuating cavities in said discharge chamber each located in such facing relation to said discharge port that the refrigerant gas discharged through said discharge port is introduced into said cavity which then allows the discharged refrigerant gas to be expanded therein for effectively attenuating the pulsations of the refrigerant gas.

Thus, interference of flows of the refrigerant gases from the respective cylinder bores takes place only after the pulsations thereof have been effectively attenuated by the cavities, so that the development of harmful and unpleasant vibrations and noise in a pipe and condenser in the air conditioning system can be greatly reduced to a satisfactory level.

This invention is also advantageous in that it can provide an attenuating device which is simple in construction and therefore inexpensive to manufacture while providing effective attenuation of the refrigerant gas pulsations.

The above and other objects, features and advantages of the present invention will become apparent to those skilled in the art from the following description of a preferred embodiment of the device according to the invention, which description is made with reference to the accompanying drawings, wherein:

BRIEF DESCRIPTION OF THE DRAWINGS

FIG. 1(*b*) is a transverse cross-section taken along the line A—A of FIG. 1(*a*);

FIG. 2(*b*) is a transverse cross-section taken along the line B—B of FIG. 2(*a*);

FIG. 2(*c*) is a sectional view taken along the line C—C of FIG. 2(*b*) showing a further modification.

DETAILED DESCRIPTION OF THE PREFERRED EMBODIMENT

The following will describe the preferred embodiment of the device of the invention as applied to a wobble plate type refrigerant gas compressor.

Figure 1:
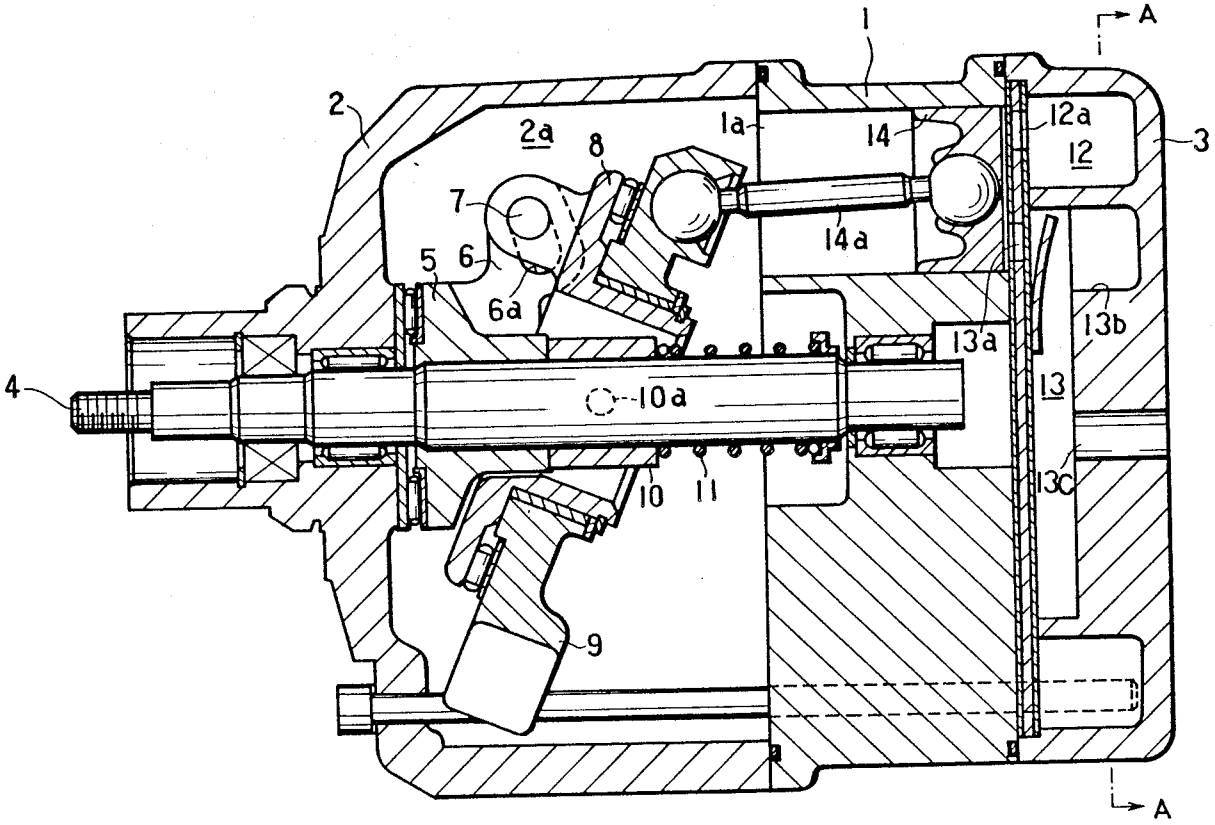
FIG. 1(*a*) is a longitudinal cross-section of a compressor having a preferred embodiment of device for attenuating refrigerant gas pulsations according to the present invention.
Figure 1:
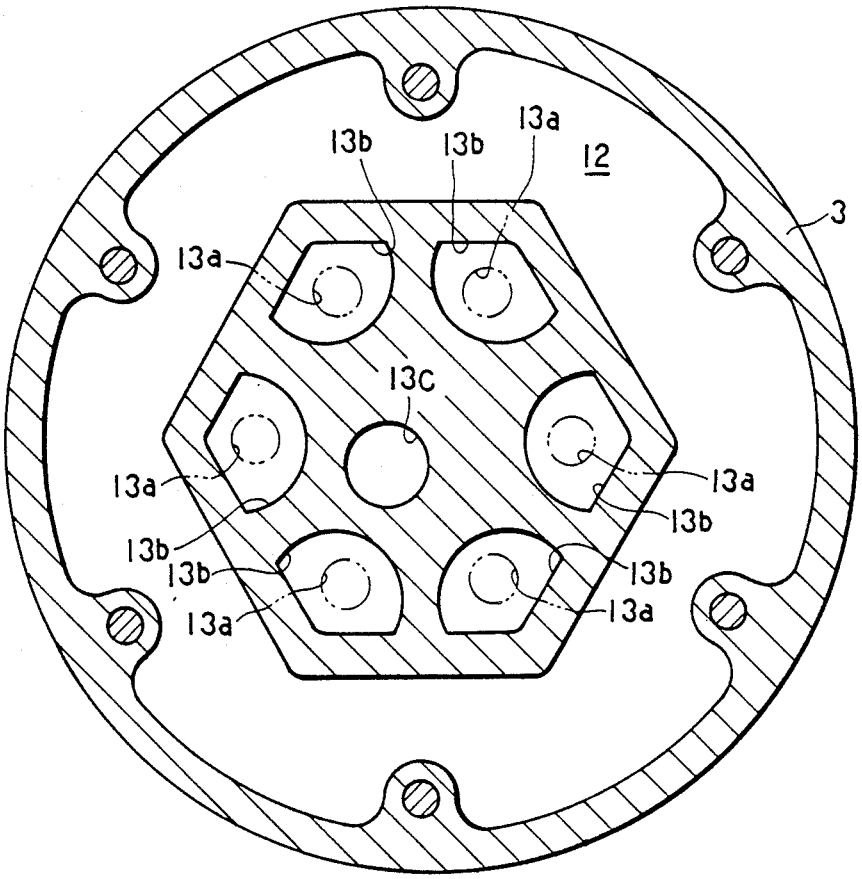

Referring to FIG. 1(*a*), there is shown a variable displacement gas compressor of the variable angle wobble plate type comprising a cylinder block 1 and front and rear housings 2 and 3 sealingly clamped to the opposite front and rear sides of the cylinder block 1, respectively. The cylinder block 1 and the front housing 2 rotatably support a central drive shaft 4 on which a support member 5 is fixedly mounted for rotation with the drive shaft. A support arm 6 is projected from the support member 5, having an end in which a guide slot 6*a* is formed for receiving therein a pin 7. The pin 7 is slidably engaged with the guide slot 6*a* and connected to a rotary drive plate 8 which is adapted to rotate with the support member 5 while making a wobbling movement Supported on the back side of the drive plate 8 is a non-rotary wobble plate 9.

A sleeve 10 is slidably mounted on the drive shaft 4 and it is urged by a spring 11 so as to be pressed against the back side of the rotary support member 5. A pair of pins 10*a* (only one being shown in FIG. 1(*a*)) protrudes radially and oppositely from the sleeve 10 to engage with holes (not shown) formed in the drive plate 8, whereby the wobble plate 9 is caused to wobble about the pins 10*a* together with the rotary drive plate 8 by rotation of the drive shaft 4.

The cylinder block 1 has formed therein six cylinder bores 1*a* (only one bore being shown in FIG. 1(*a*)) around the central drive shaft 4. The cylinder block 1 and the front housing 2 cooperate to form a crankcase chamber 2*a* . As shown in FIGS. 1(*a*) and 1(*b*), the rear housing 3 has formed therein an annular suction chamber 12 communicable with the cylinder bores 1*a* through respective suction ports 12*a* and an inner discharge chamber 13 communicable with the cylinder bores through respective discharge ports 13*a*.

A piston 14 is slidably mounted in each of the cylinder bores 1*a* and operatively connected to the wobble plate 9 by a piston rod 14*a* so that a rotary motion of the drive shaft 4 is converted to a wobbling motion of the wobble plate 9 through the drive plate 8, thus causing the pistons 14 to reciprocate in the corresponding cylinder bores 1*a*. This reciprocating motion of the piston 14 in the cylinder bore 1*a* causes a refrigerant gas to be drawn from the suction chamber 12 through the corresponding suction ports 12*a* into the bore in which the gas is compressed. The refrigerant gas thus compressed is discharged out from the cylinder bore 1*a* through its corresponding discharge port 13*a* into the discharge chamber 13.

In the above variable displacement compressor of the variable angle wobble plate type, the length of stroke that the piston 14 moves, hence the displacement of the compressor, is varied depending on the pressure differential between a pressure prevailing in the crankcase chamber 2*a* acting on the piston 14 on the side of the connecting rod 14*a* and a suction pressure acting on the opposite side of the piston, causing the wobble plate 9 to change the angle of its inclination with respect to the drive shaft 4 The pressure in the crankcase chamber 2*a* is controlled by a flow of discharged refrigerant gas into the chamber, and the flow is in turn controlled by a solenoid-operated valve (not shoWn) which is operable in response to a control signal representing a change in the cooling load of the air conditioning system.

In the discharge chamber 13 is formed as many cavities 13*b* as the cylinder bores 1*a* in facing relation to the respective discharge ports 13*a*. The cavities 13*b* are of substantially the same size and configuration and have a transverse cross-sectional area which is larger than that of the discharge ports 13*a*, as shown in FIG. 1(*a*). In the discharge chamber 13 is also formed an exit port 13*c* for the compressed refrigerant gas, which is connected by any suitable pipe to a condenser (not shown) of the air conditioning system. As shown in FIG. 1(*b*), the exit port 13*c* is located at slightly different radially spaced intervals from the respective cavities 13*b*, and, as shown in FIG. 1(*a*), the exit port 13*c* and the cavity 3 are formed so as to provide a relatively narrow flow passage therebetween in the discharge chamber 13.

In operation, a refrigerant gas compressed and discharged out from the cylinder bore 1*a* into the discharge chamber 13 through the discharge port 13*a* is firstly introduced into the corresponding cavity 13*b*. Because the cavity 13*b* is formed larger than the discharge port 13*a* in transverse cross-sectional area, the refrigerant gas coming out through the discharge port 13*a* is expanded and, therefore, its pulsations are attenuated or dampened, when it is introduced into the cavity 13*b*. Adjacently to the opening of the exit port 13*c*, such dampened refrigerant gas is then mixed with other similarly dampened refrigerant gases discharged from other cylinder bores 1*a* to be expelled out of the compressor through the exit port 13*c*. Thus, the device of the invention is so arranged that the discharged refrigerant gases undergo attenuating effect by expansion before the flows of such gases are mixed or interfere with each other in the discharge chamber, so that the pulsations to be caused after the interference can be greatly reduced In this way, merely providing cavities 13*b* of simple configuration in the discharge chamber 13, the harmful pulsations which may be transmitted to an external pipe or condenser can be effectively attenuated and, therefore, the development of vibration and noise in such pipe and condenser duo to such pulsations can be regulated successfully.

The arrangement of the exit port 13*c* with respect to the cavities 12 in the above embodiment such that it is located at slightly different radially spaced intervals from the respective cavities can work to reduce the chances of harmful interferences between flows of discharged refrigerant harmful interferences between flows of discharged refrigerant gases from the cylinder bores 1*a*.

Figure 2:
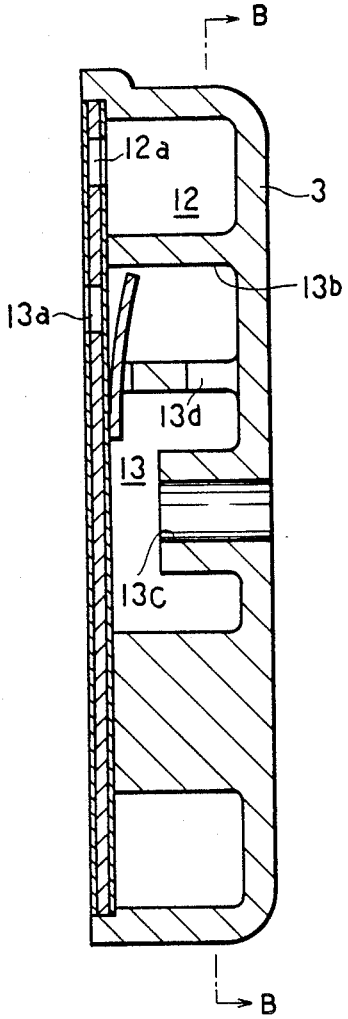
FIG. 2(*a*) is a partial longitudinal cross-section showing a modified embodiment of the device of the invention.
Figure 2:
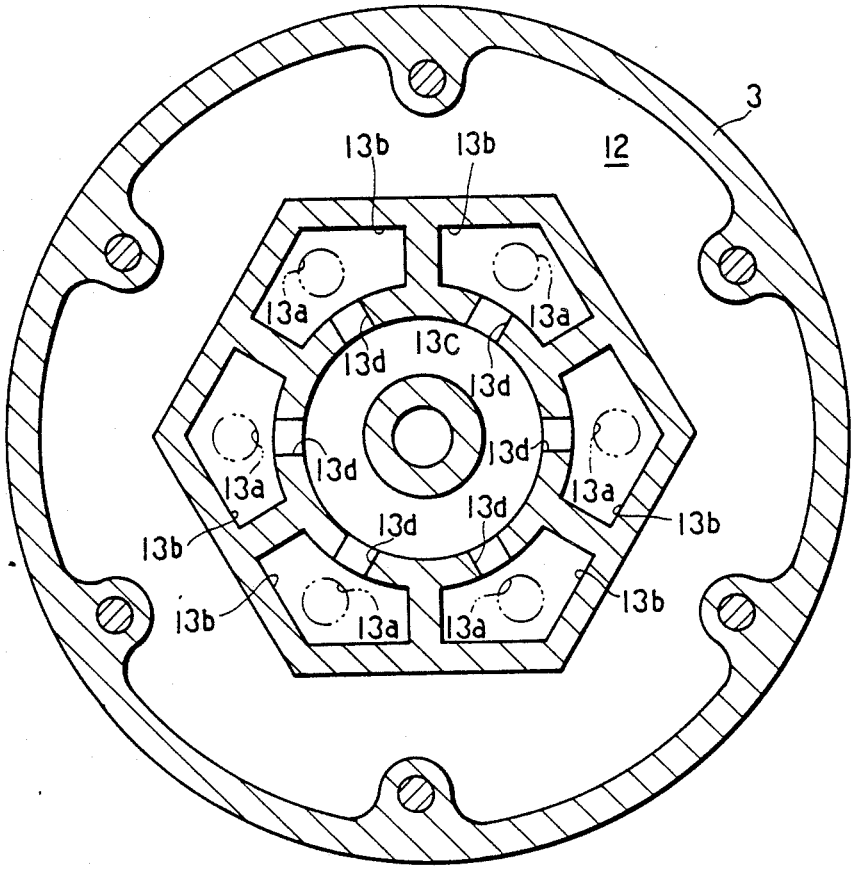
Figure 2:
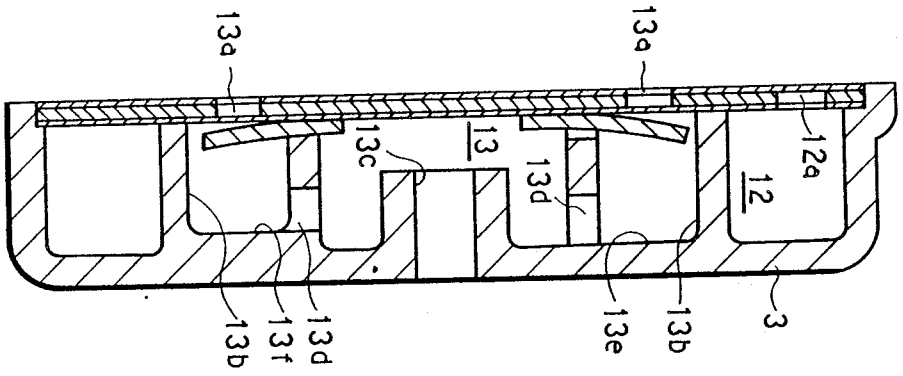

It is to be understood that the present invention is not limited to the above embodiment, but embodied in various modified forms, as exemplified in FIGS. 2(*a*) and 2(*b*).

In the modified embodiment of FIGS. 2(*a*) and 2(*b*), each cavity 13*b* is formed by the rear housing 3 so as to completely surround the opening of its corresponding discharge port 13*a*, and it is formed adjacently to its bottom with a passage 13*d* directly communicating with the discharge chamber 13. As shown in FIG. 2(*a*), the exit port 13*c* is provided by a cylindrical projection so that a flow path for the discharged refrigerant gas from the discharge port 13*a* to the exit port is reversed on its way in alternating directions for further improving the effect of attenuating the pulsations and of reducing the refrigerant gas interferences.

Additionally, in the above described embodiments, as shown at 13*e* and 13*f* in FIG. 2(*c*), their cavities 13*b* may be formed with different depths for reduction of the harmful influence of the refrigerant gas interference.

What is claimed is:

1. In a refrigerant gas compressor having formed therein a plurality of cylinder bores, a discharge chamber communicable with each of said cylinder bores through a discharge port for receiving a refrigerant gas compressed in said each cylinder bore and then discharged out therefrom through said discharge port, and an exit port having an opening formed in said discharge chamber for allowing the refrigerant gas out of said compressor through said exit port, a device for attenuating pulsations of the refrigerant gas in said discharge chamber, comprising a plurality of cavities formed with different depths in said discharge chamber in communication therewith, each of said cavities being located in such facing relation to said discharge port that the refrigerant gas discharged through said discharge port is introduced into said cavity, and the area of said each cavity in transverse cross-section being larger than that of said discharge port.

2. A device according to claim 1, wherein the opening of said exit port is positioned with respect to said cavities at different radially spaced intervals from the respective cavities.

3. A device according to claim 1, wherein a flow path for the refrigerant gas formed between said discharge port and said exit port is reversed on its way in alternating directions.

* * * * *